US011371298B2

(12) United States Patent
Wan et al.

(10) Patent No.: US 11,371,298 B2
(45) Date of Patent: Jun. 28, 2022

(54) SUPPORT DEVICE FOR ROTATION OF HIGH-CAPACITY AND COMPACT DRILL PIPE STORAGE UNIT OF SEABED DRILLING RIG IN LYING STATE

(71) Applicant: Hunan University of Science and Technology, Hunan (CN)

(72) Inventors: Buyan Wan, Hunan (CN); Yongping Jin, Hunan (CN); Deshun Liu, Hunan (CN); Xiaojun Huang, Hunan (CN)

(73) Assignee: Hunan University of Science and Technology, Xiangtan (CN)

( * ) Notice: Subject to any disclaimer, the term of this patent is extended or adjusted under 35 U.S.C. 154(b) by 139 days.

(21) Appl. No.: 16/876,737

(22) Filed: May 18, 2020

(65) Prior Publication Data

US 2021/0040800 A1 Feb. 11, 2021

(30) Foreign Application Priority Data

Aug. 5, 2019 (CN) ..... 201910716071.4

(51) Int. Cl.
*E21B 19/14* (2006.01)

(52) U.S. Cl.
CPC ..... *E21B 19/146* (2013.01); *E21B 19/143* (2013.01)

(58) Field of Classification Search
CPC ..... E21B 19/146; E21B 19/143
USPC ..... 414/22.51–22.71; 175/52; 211/70.4
See application file for complete search history.

(56) References Cited

U.S. PATENT DOCUMENTS 4,455,116 A * 6/1984 Lindstedt ..... E21B 19/146 175/52
4,892,160 A * 1/1990 Schivley, Jr ..... E21B 19/146 175/52

FOREIGN PATENT DOCUMENTS

JP 10025984 * 1/1998 ..... E21B 19/15
WO WO 2016038252 * 3/2016 ..... E21B 19/20

* cited by examiner

*Primary Examiner* — Lynn E Schwenning

(57) ABSTRACT

A support device for the rotation of a high-capacity and compact drill pipe storage unit of a seabed drilling rig in a lying state, including: a rack, a plurality of curved support frames, a plurality of lateral drill pipe stoppers and a plurality of annular fences. The curved support frames are provided parallelly and coaxially on a slideway of the rack. A separating plate is provided on each of the curved support frames. A curved support surface of each of the curved support frames is in contact with a circular edge surface of the corresponding separating plate. The annular fences are mounted on the rack. Each of the annular fences is provided with a first gap and a second gap. The first gap is provided corresponding to the lateral drill pipe stopper. The second gap is configured to allow the drill pipes enter and exit the drill pipe storage unit.

4 Claims, 6 Drawing Sheets

SUPPORT DEVICE FOR ROTATION OF HIGH-CAPACITY AND COMPACT DRILL PIPE STORAGE UNIT OF SEABED DRILLING RIG IN LYING STATE

CROSS-REFERENCE TO RELATED APPLICATION

This application claims the benefit of priority from Chinese Patent Application No. 201910716071.4, filed on Aug. 5, 2019. The content of the aforementioned application, including any intervening amendments thereto, is incorporated herein by reference in its entirety.

TECHNICAL FIELD

This application relates to seabed drilling rigs, and more particularly to a support device for the rotation of a high-capacity and compact drill pipe storage unit of a seabed drilling rig in a lying state.

BACKGROUND OF THE INVENTION

Seabed drilling rig plays a significant role in performing seabed mineral resource exploration, seabed engineering geological investigation and marine scientific research. Generally, the seabed drilling rig is lowered to the seabed by a retractable winch on a mother ship, and adjusted to be upright by a levelling leg, so that the drilling rig can be successfully used in the seabed drilling and sampling. Moreover, the drilling depth can be extended by adding drill pipes continuously. After the seabed drilling and sampling are completed, the drilling rig is retracted by the retractable winch to a deck of the mother ship. In order to satisfy the drilling and sampling requirements in deep seabed formations, the seabed drilling rig is usually equipped with a drill pipe storage unit containing several thick and long drill pipes (some of them even have a length of 4-5 m) and other auxiliary parts, allowing for a total height of 7-8 m. For convenience of the launching and retracting, the seabed drilling rig should be as small as possible in size and weight. Therefore, it is required to design the parts in a compact way. Specifically, the main shaft of the drill pipe storage unit and bearings at both ends of the main shaft are all small in size. When the seabed drilling rig is stood on the seabed, the drill pipe storage unit is upright, and at this time, it is easy for the drill pipe storage unit to rotate. However, if the seabed drilling rig is launched and retracted vertically, the seabed drilling rig will be far higher than the maximum height allowed by an A-shaped frame of the mother ship, making it extremely difficult to launch and retract the seabed drilling rig. Meanwhile, the mother ship will sway due to the action of ocean waves and currents, so that it will also be very difficult to vertically fix the seabed drilling rig on the deck of the mother ship. Moreover, the staffs will suffer from a considerable threat since they need to stand on the seabed drilling rig to place new drill pipes in the drill pipe storage unit or to transfer the drill pipes containing rock core samples from the drill pipe storage unit during the loading and unloading of drill pipes. Therefore, it is extremely important for the loading and unloading of the drill pipes and the maintenance of equipment to launch and retract seabed drilling rig, and fix the seabed drilling rig on the deck of the mother ship in a lying way.

However, when the seabed drilling rig is fixed on the deck of the mother ship in a lying way, the drill pipe storage unit thereon is also placed in a lying way. Since the drill pipe storage unit is heavy and long, and the main shaft of the drill pipe storage unit and the bearings at both ends thereof are very small in size, the drill pipe storage unit will become very bulky after the drill pipes also large in weight and length are contained. Therefore, if there is no auxiliary support device, the drill pipe storage unit will be prone to a bending deformation to be unable to rotate when in a lying state. Meanwhile, there are also great difficulties in the loading and unloading of drill pipes when the drill pipe storage unit lies.

SUMMARY OF THE INVENTION

An object of the invention is to provide a support device for the rotation of a high-capacity and compact drill pipe storage unit of a seabed drilling rig in a lying state to solve the above-mentioned technical problems, which has a simple and compact structure and easy operation, and can support and protect the rotation of the drill pipe storage unit and facilitate the loading and unloading of drill pipes when the seabed drilling rig and the drill pipe storage unit thereof are in a lying state.

To achieve the object, the invention adopts the following technical solutions. The invention provides a support device for the rotation of a high-capacity and compact drill pipe storage unit of a seabed drilling rig in a lying state, comprising:

a rack;

a plurality of curved support frames;

a plurality of lateral drill pipe stoppers; and a plurality of annular fences;

wherein the plurality of curved support frames parallel to each other are coaxially fixed on a slideway of the rack;

each of the curved support frames is provided with a separating plate; a curved support surface of each of the curved support frames is in contact with a circular edge surface of the corresponding separating plate; the separating plate is configured for an auxiliary support for the rotation of the drill pipe storage unit and drill pipes stored therein;

the annular fences are provided on the rack; an inner diameter of the annular fences is larger than an outer diameter of the drill pipe storage unit; the annular fences are coaxial with the drill pipe storage unit; each of the annular fences is provided with a first gap and a second gap; the lateral drill pipe stoppers are fixedly provided on the rack respectively corresponding to the first gap; a side surface of each of the lateral drill pipe stoppers toward the drill pipe storage unit is curved and coaxial with the separating plate; and the second gap is configured to allow the drill pipes to enter and exit the drill pipe storage unit.

In some embodiments, each of the curved support frames comprises a base plate, an inverted triangular beam and an arc plate; wherein the base plate is provided on the slideway of the rack; the inverted triangular beam is provided on the base plate; and the arc plate is provided on the inverted triangular beam.

In some embodiments, a curved groove is provided on a top surface of the arc plate; the curved groove is provided with a plurality of rollers or a curved sliding block respectively having a lubrication mechanism; and a circumscribed circle surface formed by the rollers or an inner curve surface of the sliding block forms a rolling or sliding support for an outer circular surface of the separating plate.

In some embodiments, the rack comprises an upper cross beam and a lower cross beam; ends of the upper cross beam and ends of the lower cross beam are connected through a vertical beam, respectively.

In some embodiments, each of the curved support frames comprises an arc bar; the arc bar is provided on the top surface of the arc plate, and the curved groove is provided on the arc bar.

In some embodiments, a support regulating mechanism is provided between the arc plate and the inverted triangular beam; the support regulating mechanism comprises an adjusting plate and a waist-shaped hole provided on the arc plate; the adjusting plate is horizontally fixed on the arc plate; the adjusting plate is provided with a first bolt hole and is connected to a top of the inverted triangular beam through an adjusting bolt; the inverted triangular beam is provided with a second bolt hole corresponding to the waist-shaped hole on the arc plate; and the inverted triangular beam is connected to the arc plate via a fastening bolt.

In some embodiments, each of the lateral drill pipe stoppers comprises an upper stopper, a first connecting pipe, a connecting rod, a second connecting pipe, a curved baffle and a lower stopper; wherein the second connecting pipe is larger than the first connecting pipe in length; the upper stopper is fixed on a bottom surface of the upper cross beam; the lower stopper is fixed on an upper end surface of the lower cross beam; a bottom of the upper stopper is connected to a first concave slot on a top of the first connecting pipe; a threaded hole is provided at a bottom of the first connecting pipe and is in threaded connection with a first threaded rod on an upper end of the connecting rod; a second threaded rod is provided on a lower end of the connecting rod and is in threaded connection with a second threaded hole on a top of the second connecting pipe; a second concave slot at a bottom of the second connecting pipe is connected with a top of the lower stopper; the curved baffle is welded on the second connecting pipe; and a side surface of the curved baffle is curved and coaxial with the drill pipe storage unit.

In some embodiments, each of the annular fences comprises an upper curved railing, a lower curved railing and two elastic opening-closing mechanisms; an upper surface of the upper curved railing is mounted on the upper cross beam via a first mounting plate; a lower surface of the lower curved railing is mounted on the lower cross beam via a second mounting plate; the upper and lower curved railings are coaxial with the drill pipe storage unit; the upper and lower curved railings together form each of the annular fences with the first and second gaps; the first gap is provided towards each of the lateral drill pipe stoppers to prevent the drill pipes from falling out through the first gap; and at the second gap, the two elastic opening-closing mechanisms are respectively provided on the upper and lower curved railings at an end close to the second gap.

In some embodiments, each of the two elastic opening-closing mechanisms comprises a fixing plate, a spring stop and a sphere stop; the fixing plate is provided with a waist-shaped hole; the fixing plate is fixed on the end of each of the upper and lower curved railings close to the second gap via the waist-shaped hole and a bolt; the sphere stop is provided on the fixing plate via the spring stop; and an axis of the spring stop is perpendicular to the fixing plate.

Compared with the prior art, the invention has the following beneficial effects.

1. The invention has a compact structure and easy operation, and adopts multiple curved support frames to support the rotation of the circular separating plate with pipe storage slots in the drill pipe storage unit, effectively solving the problem that due to the large weight and length of the drill pipe storage unit and small size in the main shaft of the drill pipe storage unit and the bearings at both ends thereof, the drill pipe storage unit is prone to bending deformation to fail to rotate.

2. According to the actual requirement, a support regulating mechanism is provided between the arc plate and the inverted triangular beam to real-time regulate the support force provided by the curved support mechanism to the drill pipe storage unit.

3. The lateral drill pipe stoppers introduced herein facilitate the loading and unloading of drill pipes when the drilling rig and the drill pipe storage unit thereof are in a lying state.

4. Moreover, the drill pipes in the drill pipe storage unit are well protected by the annular fences.

Figure 1:
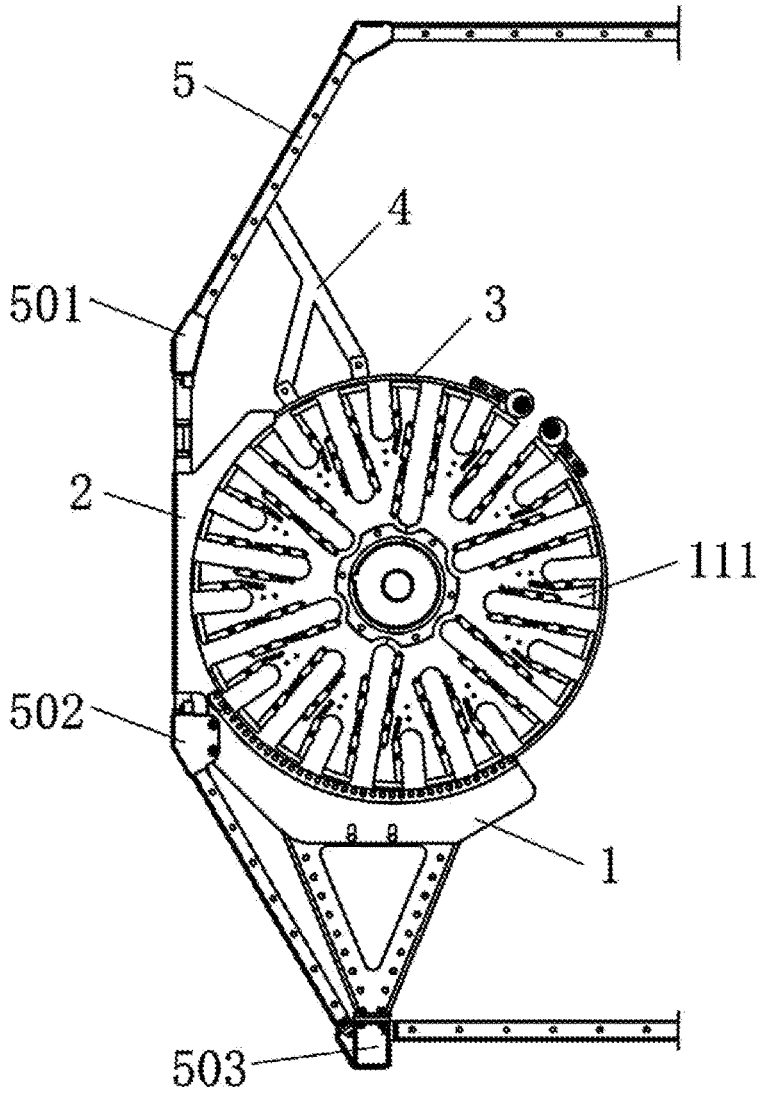
FIG. 1 is a schematic diagram of a support device for the rotation of a high-capacity and compact drill pipe storage unit of a seabed drilling rig in a lying state according to the present invention.

In the drawings, 1—curved support frame, 101—base plate, 102—inverted triangular beam, 103—arc plate, 1031—curved groove, 104—arc bar, 105—roller, 106—waist-shaped hole, 107—fastening bolt, 108—adjusting bolt, 109—adjusting plate, 110—curved sliding block, 111—separating plate, 2—lateral drill pipe stopper, 201—upper stopper, 202—first connecting pipe, 203—connecting rod, 204—second connecting pipe, 205—curved baffle, 206—lower stopper, 3—annular fence, 301—upper curved railing, 302—elastic opening-closing mechanism, 30201—fixing plate, 30202—spring stop, 30203—sphere stop, 303—lower curved railing, 304—first gap, 305—second gap, 4—first mounting plate, 5—rack, 501—upper cross beam, 502—lower cross beam, 503—slideway, 504—vertical beam, 6—drill pipe storage unit, 7—second mounting plate.

DETAILED DESCRIPTION OF EMBODIMENTS

The invention will be further described with reference to the accompanying drawings.

Figure 2:
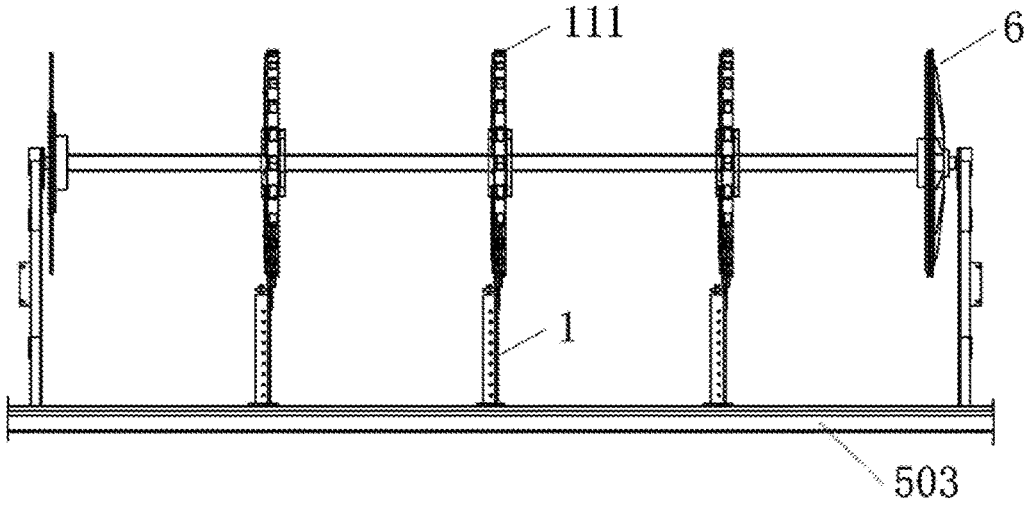
FIG. 2 schematically shows the arrangement of a curved support frame and a separating plate of the support device according to the present invention.
Figure 3:
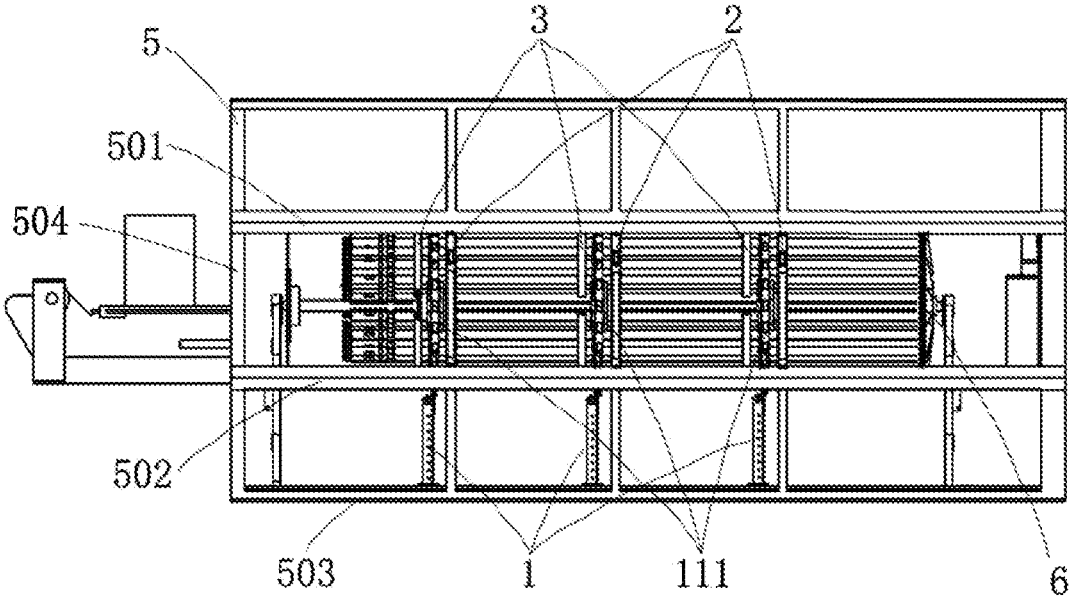
FIG. 3 schematically shows where the support device is provided on a seabed drilling rig according to the present invention.

As shown in FIGS. 1-3, the invention provides a support device for the rotation of a high-capacity and compact drill pipe storage unit of a seabed drilling rig in a lying state, including: a rack 5, three curved support frames 1, three lateral drill pipe stoppers 2 and three annular fences 3. It should be understood that the curved support frames 1, the lateral drill pipe stoppers 2 and the annular fences 3 may be different in number. The rack 5 includes an upper cross beam 501 and a lower cross beam 502. Ends of the upper crossbeam 501 and ends of the lower crossbeam 502 are connected through a vertical beam 504, respectively. The curved support frames 1 parallel to each other are coaxially fixed on a slideway 503 of the rack 5. A separating plate 111 is provided on each of the curved support frames 1, and a curved support surface of each of the curved support frames 1 is in contact with a circular edge surface of the corresponding separating plate 111. The separating plate 111 is configured for an auxiliary support for the rotation of the drill pipe storage unit and drill pipes stored therein.

Figure 4:
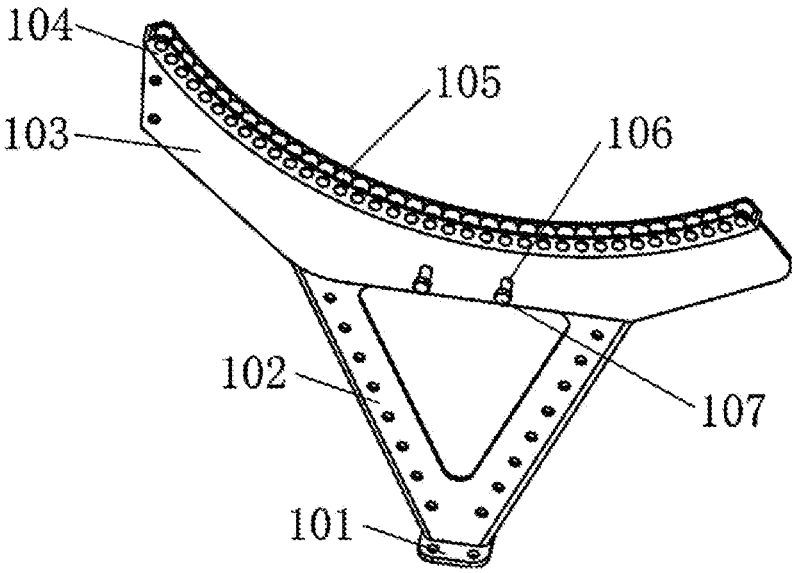
FIG. 4 illustrates the curved support frame according to Embodiment 1 of the present invention, when viewed from the front.
Figure 5:
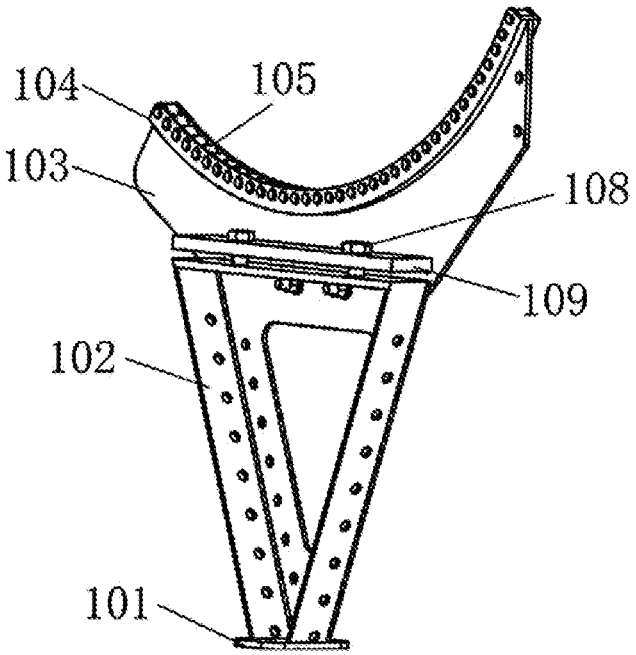
FIG. 5 illustrates the curved support frame according to Embodiment 1 of the present invention, when viewed from the rear.
Figure 6:
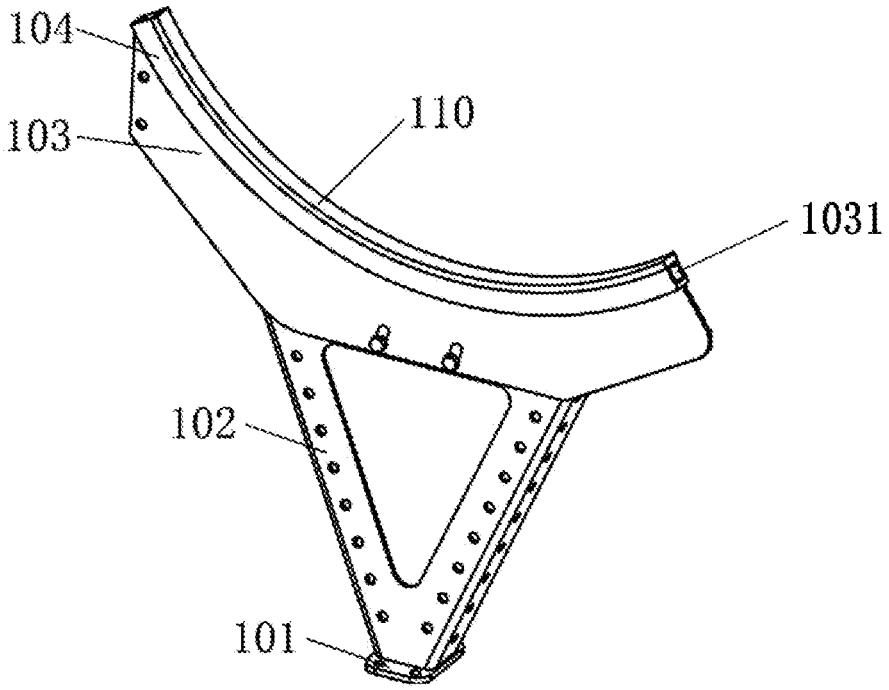
FIG. 6 illustrates the curved support frame according to Embodiment 2 of the present invention, when viewed from the front.

As shown in FIGS. 4-6, each of the curved support frames 1 includes a base plate 101, an inverted triangular beam 102 and an arc plate 103. The base plate 101 is provided on the slideway 503 of the rack 5. The inverted triangular beam 102 is provided on the base plate 101. The arc plate 103 is provided on the inverted triangular beam 102. An arc bar 104 is further provided on a top surface of the arc plate 103 and has a U-shaped cross section. The curved groove 1031 of the arc bar is provided with a plurality of rollers 105 or a curved sliding block 110 with a lubrication mechanism. A circumscribed circle surface formed by the rollers 105 or an inner curve surface of the sliding block 110 forms a rolling or sliding support for an outer circular surface of the separating plate 111.

As shown in FIG. 5, a support regulating mechanism is provided between the arc plate 103 and the inverted triangular beam 102, and the support regulating mechanism includes an adjusting plate 109 and a waist-shaped hole 106 provided on the arc plate 103. The adjusting plate 109 is horizontally fixed on the arc plate 103 and is perpendicular to the arc plate 103. A first bolt hole is provided on the adjusting plate 109, and the adjusting plate 109 is connected with a top of the inverted triangular beam 102 via the first bolt hole and an adjusting bolt 108. The inverted triangular beam 102 is provided with a second bolt hole corresponding to the waist-shaped hole 106 on the arc plate 103 and is connected to the arc plate 103 via the second bolt hole and a fastening bolt 107.

Figure 7:
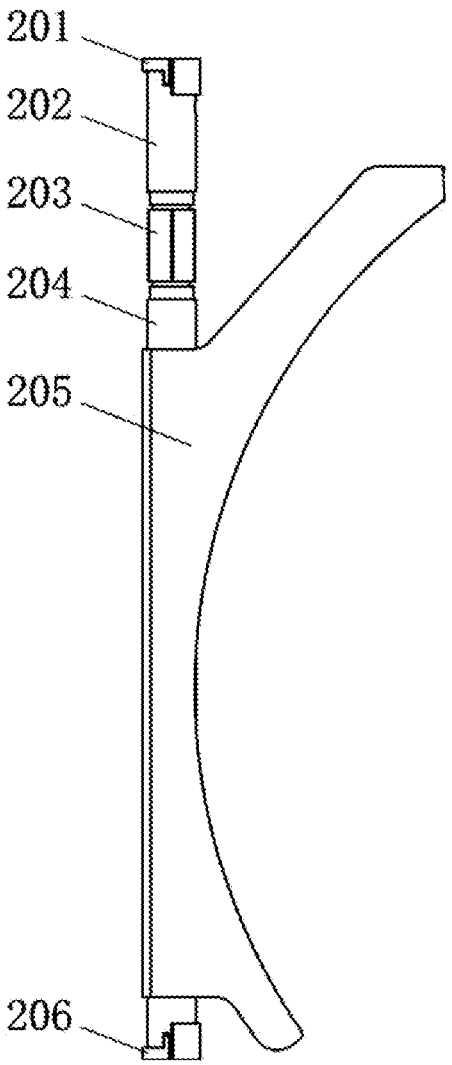
FIG. 7 is a schematic diagram of a lateral drill pipe stopper of the support device according to the present invention.
Figure 8:
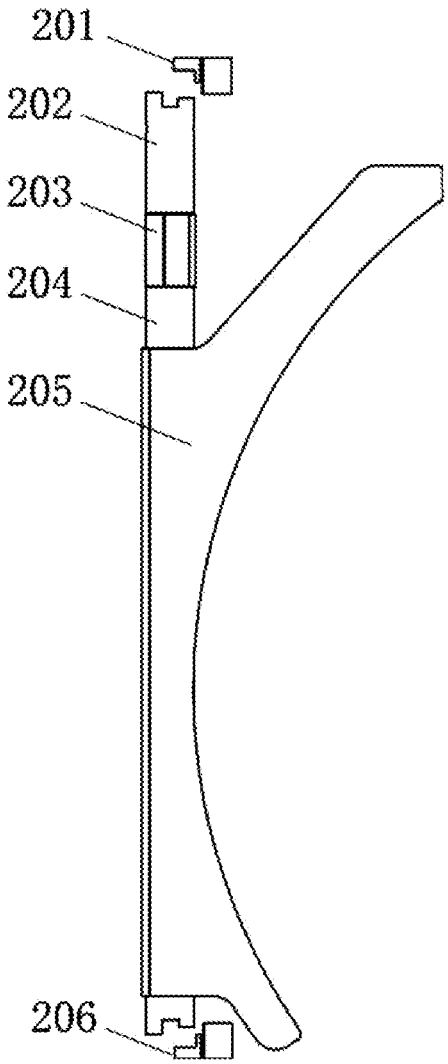
FIG. 8 is a schematic diagram of the lateral drill pipe stopper after disassembled according to the present invention.
Figure 9:
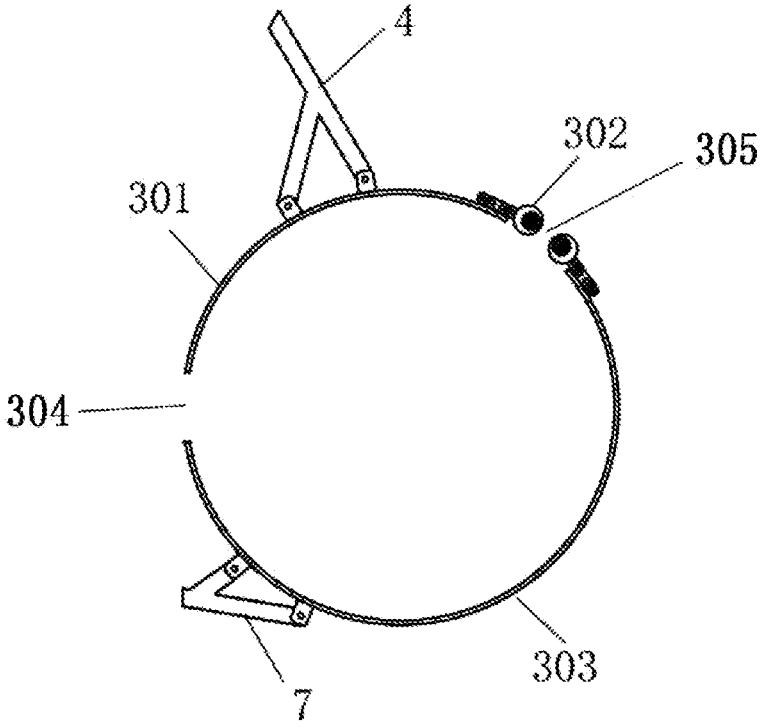
FIG. 9 is a schematic diagram of an annular fence of the support device according to the present invention.
Figure 10:
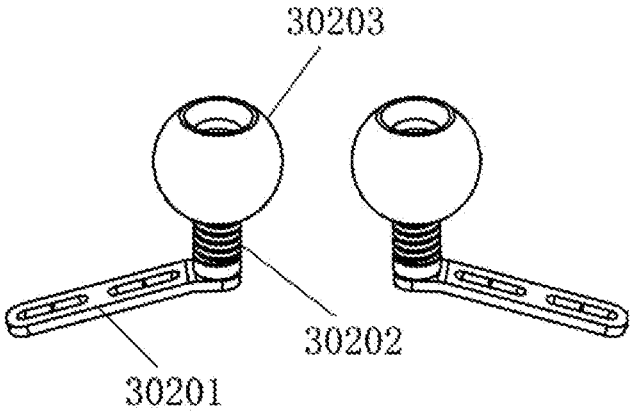
FIG. 10 illustrates an elastic opening-closing mechanism of the annular fence of the support device according to the present invention, when viewed from the front.

As shown in FIGS. 3, 7 and 8, the lateral drill pipe stoppers 2 are provided on the rack 5 and are parallel to the vertical beam 504. The lateral drill pipe stoppers 2 are provided between two vertical beams 504. A length of the drill pipe storage unit 6 is smaller than a distance between the two vertical beams 504. Each of the lateral drill pipe stoppers 2 includes an upper stopper 201, a first connecting pipe 202, a connecting rod 203, a second connecting pipe 204, a curved baffle 205 and a lower stopper 206, where the second connecting pipe 204 is larger than the first connecting pipe 202 in length. The upper stopper 201 is fixed on a bottom surface of the upper cross beam 501 of the rack 5, and the lower stopper 206 is fixed on an upper end surface of the lower cross beam 502 of the rack 5. The upper stopper 201 is connected to a first concave slot on a top of the first connecting pipe 202. A first threaded hole at a bottom of the first connecting pipe 202 is in threaded connection with a first threaded rod on an upper end of the connecting rod 203. A second threaded rod on a lower end of the connecting rod 203 is in threaded connection with a second threaded hole on a top of the second connecting pipe 204. A second concave slot at a bottom of the second connecting pipe 204 is connected with a top of the lower stopper 206; and the curved baffle 205 is welded on the second connecting pipe 204. A side surface of the curved baffle 205 is curved and coaxial with the drill pipe storage unit 6.

As shown in FIGS. 1, 3, 9 and 10, each of the annular fences 3 includes an upper curved railing 301, a lower curved railing 303 and two elastic opening-closing mechanisms 302. A reverse surface of the upper curved railing 301 is installed on the upper cross beam 501 via a first mounting plate 4; and a reverse surface of the lower curved railing 303 is installed on the lower cross beam 502 via a second mounting plate 7. The upper curved railing 301 and the lower curved railing 303 are coaxial with the drill pipe storage unit 6. A first gap 304 and a second gap 305 are generated on each of the annular fences 3 by the curved railing 301 and the lower curved railing 303. The first gap 304 is provided towards each of the lateral drill pipe stoppers 2 to prevent the drill pipes from falling out through the first gap 304; and at the second gap 305, the two elastic opening-closing mechanisms 302 are respectively provided on the curved railing 301 and the lower curved railing 303 at an end close to the second gap 305. Each of the two elastic opening-closing mechanisms 302 includes a fixing plate 30201, a spring stop 30202 and a sphere stop 30203. The fixing plate 30201 is provided with a waist-shaped hole. The fixing plate 30201 is fixed on an end of each of the curved railing 301 and the lower curved railing 303 close to the second gap 305 via the waist-shaped hole and a bolt. The sphere stop 30203 is provided on the fixing plate 30201 via the spring stop 30202. An axis of the spring stop 30202 is perpendicular to the fixing plate 30201.

As shown in FIGS. 3, 7 and 8, the lateral drill pipe stoppers 2 are provided on the rack 5 and are parallel to the vertical beam 504. The lateral drill pipe stoppers 2 are provided between two vertical beams 504. A length of the drill pipe storage unit 6 is smaller than a distance between the two vertical beams 504. Each of the lateral drill pipe stoppers 2 includes an upper stopper 201, a first connecting pipe 202, a connecting rod 203, a second connecting pipe 204, a curved baffle 205 and a lower stopper 206, where the second connecting pipe 204 is larger than the first connecting pipe 202 in length. The upper stopper 201 is fixed on a bottom surface of the upper cross beam 501 of the rack 5, and the lower stopper 206 is fixed on an upper end surface of the lower cross beam 502 of the rack 5. The upper stopper 201 is connected to a first concave slot on a top of the first connecting pipe 202. A first threaded hole at a bottom of the first connecting pipe 202 is in threaded connection with a first threaded rod on an upper end of the connecting rod 203. A second threaded rod on a lower end of the connecting rod 203 is in threaded connection with a second threaded hole on a top of the second connecting pipe 204. A second concave slot at a bottom of the second connecting pipe 204 is connected with a top of the lower stopper 206; and the curved baffle 205 is welded on the second connecting pipe 204. A side surface of the curved baffle 205 is curved and coaxial with the drill pipe storage unit 6.

As shown in FIGS. 1, 3, 9 and 10, each of the annular fences 3 includes an upper curved railing 301, a lower curved railing 303 and two elastic opening-closing mechanisms 302. A reverse surface of the upper curved railing 301 is installed on the upper cross beam 501 via a first mounting plate 4; and a reverse surface of the lower curved railing 303 is installed on the lower cross beam 502 via a second mounting plate 7. The upper curved railing 301 and the lower curved railing 303 are coaxial with the drill pipe storage unit 6. A first gap 304 and a second gap 305 are generated on each of the annular fences 3 by the curved railing 301 and the lower curved railing 303. The first gap 304 is provided towards each of the lateral drill pipe stoppers 2 to prevent the drill pipes from falling out through the first gap 304; and at the second gap 305, the two elastic opening-closing mechanisms 302 are respectively provided on the curved railing 301 and the lower curved railing 303 at an end close to the second gap 305. Each of the two elastic opening-closing mechanisms 302 includes a fixing plate 30201, a spring stop 30202 and a sphere stop 30203. The fixing plate 30201 is provided with a waist-shaped hole. The fixing plate 30201 is fixed on an end of each of the curved railing 301 and the lower curved railing 303 close to the second gap 305 via the waist-shaped hole and a bolt. The sphere stop 30203 is provided on the fixing plate 30201 via the spring stop 30202. An axis of the spring stop 30202 is perpendicular to the fixing plate 30201.

What is claimed is:

1. A support device for the rotation of a compact drill pipe storage unit of a seabed drilling rig in a lying state, comprising:

a rack;

a plurality of curved support frames;

a plurality of lateral drill pipe stoppers; and a plurality of annular fences;

wherein the plurality of curved support frames parallel to each other are coaxially fixed on a slideway of the rack;

each of the curved support frames is provided with a separating plate;

a curved support surface of each of the curved support frames is in contact with a circular edge surface of the corresponding separating plate;

the separating plate is configured for an auxiliary support for the rotation of the drill pipe storage unit and drill pipes stored therein;

the annular fences are provided on the rack;

an inner diameter of the annular fences is larger than an outer diameter of the drill pipe storage unit;

the annular fences are coaxial with the drill pipe storage unit;

each of the annular fences is provided with a first gap and a second gap;

each of the plurality of lateral drill pipe stoppers is fixed to the rack at a location corresponding to the first gap, with the plurality of lateral drill pipe stoppers being spaced apart along a length of the drill pipe storage unit;

a side surface of each of the lateral drill pipe stoppers toward the drill pipe storage unit is curved and coaxial with the separating plate;

the second gap is configured to allow the drill pipes to enter and exit the drill pipe storage unit;

each of the curved support frames comprises a base plate, an inverted triangular beam and an arc plate; wherein the base plate is provided on the slideway of the rack;

the inverted triangular beam is provided on the base plate; and the arc plate is provided on the inverted triangular beam;

a curved groove is provided on a top surface of the arc plate;

the curved groove is provided with a plurality of rollers or a curved sliding block;

a circumscribed circle surface formed by the rollers or an inner curve surface of the sliding block forms a rolling or sliding support for an outer circular surface of the separating plate;

the rack comprises an upper cross beam and a lower cross beam; and a vertical beam connects the upper cross beam and the lower cross beam at both ends of the upper cross beam and the lower cross beam.

2. The support device of claim 1, wherein each of the curved support frames comprise an arc bar; the arc bar is provided on the top surface of the arc plate, and the curved groove is provided on the arc bar.

3. The support device of claim 1, wherein a support regulating mechanism is provided between the arc plate and the inverted triangular beam; the support regulating mechanism comprises an adjusting plate and a waist-shaped hole provided on the arc plate; the adjusting plate is horizontally fixed on the arc plate; the adjusting plate is provided with a first bolt hole and is connected to a top of the inverted triangular beam through an adjusting bolt; the inverted triangular beam is provided with a second bolt hole corresponding to the waist-shaped hole on the arc plate; and the inverted triangular beam is connected to the arc plate via a fastening bolt.

4. The support device of claim 1, wherein each of the annular fences comprises an upper curved railing, a lower curved railing and two elastic opening-closing mechanisms; an upper surface of the upper curved railing is mounted on the upper cross beam via a first mounting plate; a lower surface of the lower curved railing is mounted on the lower cross beam via a second mounting plate; the upper and lower curved railings are coaxial with the drill pipe storage unit; the upper and lower curved railings together form each of the annular fences with the first and second gaps; the first gap is provided towards each of the lateral drill pipe stoppers to prevent the drill pipes from falling out through the first gap; and at the second gap, the two elastic opening-closing mechanisms are respectively provided on the upper and lower curved railings at an end close to the second gap.

* * * * *